US006923033B2

(12) United States Patent
Hering

(10) Patent No.: US 6,923,033 B2
(45) Date of Patent: Aug. 2, 2005

(54) ROLLER SYSTEM FOR FLATTENING IRREGULARLY SHAPED, BENT PIECES OF SCRAP SHEET METAL

(75) Inventor: Alfred George Hering, Plymouth, MI (US)

(73) Assignee: Soave Enterprises, LLC, Detroit, MI (US)

( * ) Notice: Subject to any disclaimer, the term of this patent is extended or adjusted under 35 U.S.C. 154(b) by 111 days.

(21) Appl. No.: 10/677,618

(22) Filed: Oct. 2, 2003

(65) Prior Publication Data

US 2005/0072200 A1 Apr. 7, 2005

(51) Int. Cl.[7] ..... B21D 3/02

(52) U.S. Cl. ..... 72/133; 72/199; 72/252.5; 72/197; 29/403.1

(58) Field of Search ..... 72/133, 160, 252.5, 72/199, 197, 198; 492/1, 30; 419/43; 29/403.1, 403.2

(56) References Cited

U.S. PATENT DOCUMENTS 4,004,479 A * 1/1977 Bodnar ..... 83/345
4,504,019 A * 3/1985 Newell et al. ..... 241/73
4,739,641 A * 4/1988 Hering ..... 72/199
5,890,424 A * 4/1999 Deters ..... 100/37
5,911,374 A * 6/1999 Biehn ..... 241/236

* cited by examiner

*Primary Examiner*—Daniel C. Crane
(74) *Attorney, Agent, or Firm*—Harness, Dickey & Pierce, P.L.C.

(57) ABSTRACT

A roller system for flattening irregularly shaped pieces of scrap sheet metal comprises a pair of parallel, horizontally arranged large rollers forming a downwardly converging nip between them. Each roller is formed of curved steel sheets bent to form a cylindrical shape for the rollers. A series of curved, steel liner plates overlay and cover the surfaces of the cylinders. The plates are made of a harder material than the steel sheets. The liner plates on each cylinder are arranged end-to-end and are mechanically fastened to their respective rollers so that the opposite ends of the plates provide a leading edge and a trailing edge. The trailing edge of each plate is chamfered and is arranged against a generally radially directed, blunt edge surface of the leading end of the next plate to form a roughly triangularly shaped in cross-section groove extending longitudinally of the exterior surface of the rollers. One of the rollers is elevated relative to the other roller and pieces of scrap metal are dropped along a chute arranged at an angle to the vertical into the converging nip for squeezing the pieces flat as they pass through the nip between the rollers.

8 Claims, 2 Drawing Sheets

ROLLER SYSTEM FOR FLATTENING IRREGULARLY SHAPED, BENT PIECES OF SCRAP SHEET METAL

BACKGROUND OF THE INVENTION

This invention relates to a roller system for flattening irregularly shaped pieces of scrap sheet metal that are generated during the manufacture of stamped metal parts or other metal forming operations. Such scrap sheet metal pieces are typically re-used or recycled by melting the pieces in a furnace and, thereafter, forming new metal sheets from the melted metal. Ordinarily, scrap metal of the type that is left over from stamping or cutting away portions of a larger metal sheet, is bent in three planes and is irregular in size and shape. Thus, pieces of such scrap are difficult to handle. Moreover, those bent scrap pieces are bulky. Therefore, collections of loose pieces require considerable space to transport them from the scrap generating source, such as a stamping press, to a remotely located melt furnace.

In the past, to reduce the volume of a collection of the loose, pieces, the pieces have been tightly compacted together into large, bulky blocks or bales for transport from the generating source or factory to the recycling furnace facility. Because of the irregular shapes and bends of the loose pieces, transporting them in large containers or by trucks requires considerable space. Compressing the pieces into a compressed mass substantially increases the amount of material that can be loaded into a container or truck, which substantially reduces the costs of transportation. However, a substantially solid block or bale is more difficult to melt when dumped into a melt furnace. The difficulty arises because individual pieces melt faster since their surfaces are directly exposed to the heat energy. In the case of a compressed block, the exposed surface areas are limited so that more time and heat energy is required for the heat to penetrate and melt the compacted block.

Thus, on the one hand, it is desirable to feed the separate pieces of scrap sheet steel into the melt furnace so as to more quickly expose their surfaces to the heat energy for more rapid melting. But, on the other hand, moving the collection of loose individual pieces to the furnace requires so much more transportation space than a compacted block-like mass. Consequently, it would be desirable to flatten the bent sheets so that they require less space for transporting them while they remain separate for loading them into a furnace.

Attempts have been made in the past to provide equipment which will rapidly and inexpensively flatten irregular and bent scrap sheet metal pieces to decrease the amount of volumetric space needed for transportation of large quantities of scrap pieces. Flattened pieces substantially reduce the volume of individual scrap metal pieces so that they may be loosely transported, such as in a large bin, without compacting them into a large block or blade.

An example of prior flattening equipment is disclosed in my U.S. Pat. No. 4,739,641 issued Apr. 26, 1988 for a "Process And Apparatus For Flattening Sheet Gauge Metal Scrap." The equipment and process disclosed in that patent flattens irregularly size and shape and multiply bent scrap pieces by moving and squeezing the pieces through the nip of a pair of aligned rollers. Thus, those pieces may be transported loosely in bins or other containers without compacting them into conventional, large compressed blocks.

However, a problem which arises from time to time with that type of roller flattening equipment, is that pieces of the scrap fed into the space between the rollers sometimes will clump or entangle together. That may jam the rollers or block further feed into the nip between the rollers. Breaking up the blockage requires an attendant to separate the two rollers sufficiently to enable the entire clump to pass through the nip between the rollers without any flattening of those pieces. When such clumping occurs, particularly at unexpected moments, the attendant must be alert and available to immediately separate the rollers to clear the blockage. In that event, separating the rollers involves moving one roller away from the other to momentarily enlarge the gap between the rollers. After the clump of entangled unflattened pieces pass through the widened nip, the rollers must be restored to their operating positions where they are again close to each other. During the separation of the rollers, the feed of incoming scrap must be turned off momentarily to prevent the passage of a significant number of unflattened, separate pieces along with the clump.

In addition, there are times when the rollers become slippery due to the accumulation of oil or other lubricants carried to the rollers by the scrap metal. Lubricants are normally applied to the surfaces of sheet metal when the metal is stamped or cut prior to the formation of the scrap pieces. When that happens, pieces of sheet metal that pass into the space between the adjacent rollers tend to simply slide around above the flattening gap between the rollers and fail to pass through the gap. The pieces may remain upon the slippery surfaces of the rollers above the gap or nip until an attendant physically forces the pieces through the narrow gap or nip. That slows the automatic flattening operation and requires manual attention. If the roller surfaces become too slippery, it is necessary to shut down the system and to clean the roller surfaces so as to enable sufficient friction to be developed between the rollers and the scrap metal pieces for drawing the scrap metal through the nip.

Thus, this invention is concerned with improved flattening equipment, which utilizes a pair of flattening rollers for squeezing the irregular, bent or contorted pieces of sheet metal, by reducing clumping of the pieces and hold-back or flow interruption resulting from the slipperiness of roller surfaces which reduces the needed friction for driving the pieces through the nip or gap between the rollers. Moreover, this invention is concerned with providing increased compressive forces which will better and more quickly flatten conventional scrap sheet metal pieces.

SUMMARY OF THE INVENTION

This invention contemplates providing a system for rapidly flattening of irregular shaped, non-planar bent pieces of sheet metal. Such pieces may be irregularly bent out of the flat plane of the original sheet metal from which they are made. The system includes a pair of large rollers, such as on the order of six feet or more in diameter. The rollers are arranged closely adjacent to form a converging nip or gap between them. The irregular pieces of scrap sheet metal are dropped between the two rollers, that is, into the wider opened end of the nip. Thus, they are carried downwardly through the narrow nip so that as they pass through the narrow gap between the rollers, the pieces are flattened by the rollers.

The rollers are provided with spaced apart, longitudinally extending grooves formed on their exterior surfaces. Preferably, the grooves are approximately triangular in cross-sectional shape. Curved metal plates, made of a relatively hard steel material, are secured upon the exterior surfaces of the rollers. These plates overlap and cover the outer surfaces of the roller. The plates are arranged end-to-end. The leading end of each plate, relative to the direction of rotation of the particular roller, is blunt or roughly radially aligned relative to the central axis of the roller. The trailing end of each plate is chamfered. The adjacent pairs of blunt leading ends and chamfered trailing ends provide the approximately triangular cross-sectional shape of the groove. Thus, the grooves, as they rotate with the rollers, pull or move the scrap pieces between the rollers and through the narrow gap between the rollers.

Preferably the axes of the rollers are substantially horizontal and one of the rollers is arranged at a higher elevation than the other roller. With that arrangement, the axis of rotation of one roller is elevated relative to the axis of the other roller. Scrap metal pieces may be gravity-dropped downwardly between the rollers into the converging nip so that the vertically offset roller arrangement, together with the blunt leading edges of the grooves, direct and pull the individual scrap pieces into and through the narrow gap, notwithstanding any slipperiness due to deposits of oil or other lubricants on the rollers or on the pieces.

An object of this invention is to provide a relatively simple roller system which will quickly flatten large quantities of non-planar scrap pieces which result from stamping or metal forming processes. The system is relatively inexpensive and manual labor required. The equipment has a relatively long life span and requires little maintenance.

Another object of this invention is to provide a flattening system comprising very large or oversized cylindrical rollers having surfaces covered by plates made of a hard steel material which may be considerably harder than the material forming the roller surfaces. These exterior liner plates may be easily replaceable when worn or damaged so as to maintain the useful lives of the rollers.

Still another object of this invention is to provide grooves on the exteriors of the flattening rollers. Preferably the grooves are formed by chamfering the trailing ends of the surface liner plates where the trailing end of one plate abuts the leading end of the next plate. Thus, the grooves are essentially damage-proof and are easily maintained or replaced if damage should occur by removing and replacing one or more of the hard liner plates secured to the exterior of each roller.

Yet a further advantage of this invention is to provide oversized rollers which provide sufficient radial force to compress between them non-planar steel scrap pieces and to pull the individual scrap pieces between them so as to minimize or prevent clumping of the pieces which might jam or block the flow of pieces.

These and other objects and advantages will become apparent upon reading the following description, of which the attached drawings form a part.

DETAILED DESCRIPTION

Figure 1:
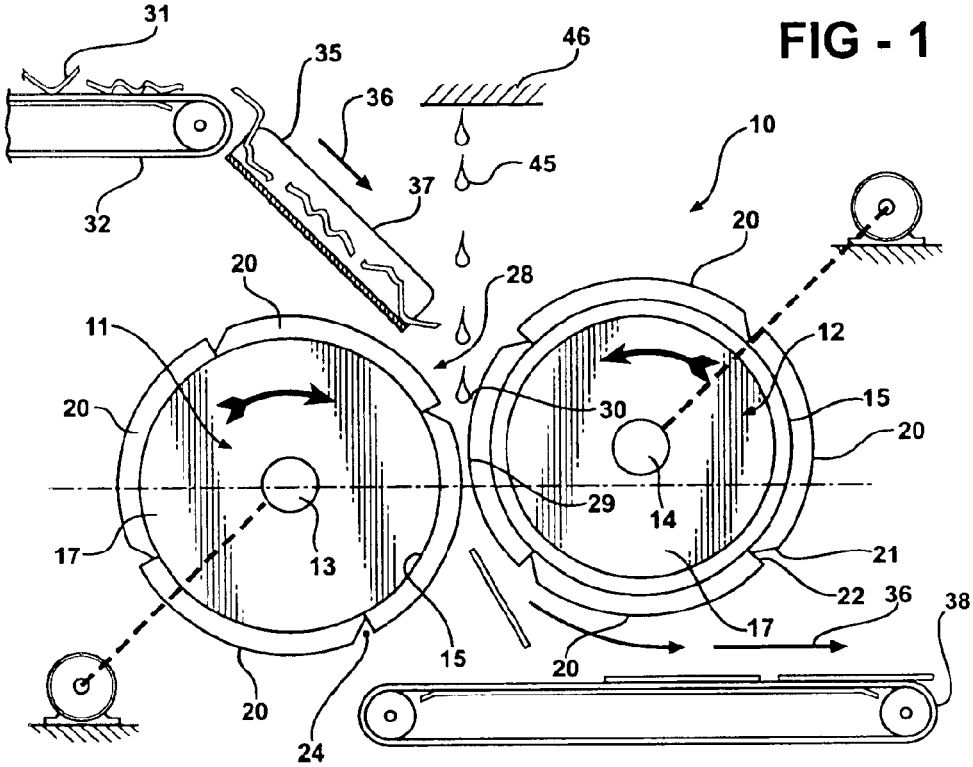
FIG. 1 schematically illustrates the roller system, including the arrangement of the rollers, for delivering scrap metal pieces to, and through, the gap between the opposing rollers.
Figure 3:
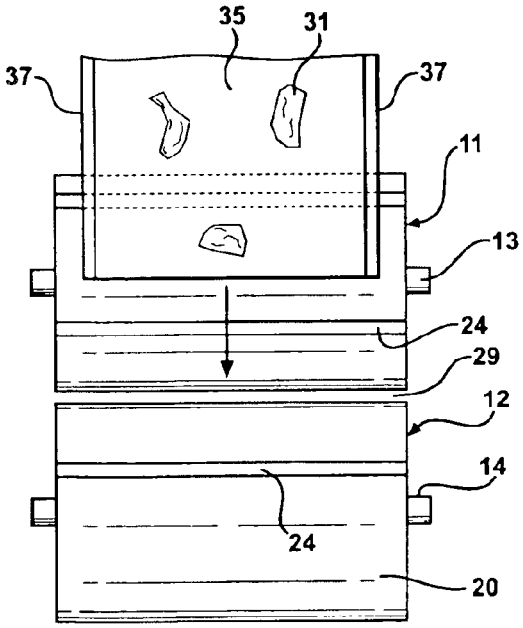
FIG. 3 is a reduced-sized, vertically downwardly, view of the adjacent rollers and the chute for delivering scrap pieces to the roller nip.
Figure 4:
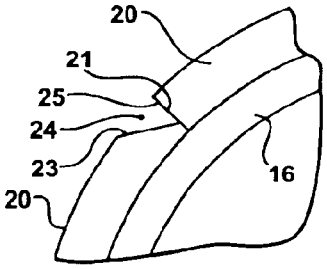
FIG. 4 is an enlarged, fragmentary, schematic view showing the formation of the grooves provided by the adjacent leading and trailing edges of a pair of aligned liner plates.

FIG. 1 schematically illustrates the roller system 10. The system includes a pair of substantially identical rollers 11 and 12. These rollers are provided with horizontally arranged axles 13 and 14. The cylindrical surfaces 15 of the rollers are formed of bent steel sheets 16. The rollers have end walls 17 to form the closed-end cylindrical shapes. The construction of the rollers is conventional. Those skilled in the art would know how to assemble such rollers with necessary reinforcing interior structural braces. The rollers are preferably of a substantial size in diameter, such as on the order of six feet or more in diameter. Thus, it is contemplated to use oversized or enlarged rollers, which are substantially greater in diameter than prior rollers that have been used for flattening purposes.

The exterior cylindrical surfaces of the rollers are covered with liner plates 20. The liner plates are arranged end-to-end in a series to surround the surface of the respective rollers. Each of the liner plates has a leading edge 21 and a trailing edge 22. The leading edge of each liner plate is formed as a blunt surface made by cutting the edge of the plate roughly perpendicular to the plane of the plate before it is curved, or preferably cutting the edge in a radial direction relative to the center of curvature of the plate and the roller axis. The trailing edges of the plates are formed with a chamfer 23. Thus, a generally triangular, in-cross-section, shaped groove 24 is formed by the pairs of adjacent blunt leading edges and the chamfered trailing edges. The blunt leading edges 21 provide blunt shoulders 25.

The liner plates are preferably made of a steel metal material which is considerably harder than the steel material used to make the rollers. The plates are secured upon the roller surfaces by screws 26 or other mechanical fasteners. Thus, the individual liner plates may be removed and replaced, when necessary. However, being of a harder material than the material forming the surfaces of the cylindrical rollers, they provide substantially greater wear resistance and enable the forces that are applied in the nip, between the rollers, to be more uniform than in prior rollers. Because the hard liner plates are more resistant to bending when curving the plates than the less hard material used to make the rollers, the use of the series of separate plates makes it easier to bend each of the liner plates into the shape of a segment of a circle. The less hard material forming the rollers, preferably is more ductile or bendable than the liner material, so that the roller material is more easily bent for assembly into the cylindrical shape of the rollers. The particular metal material may be selected by persons skilled in the metallurgical art from commercially available metals.

The roller axles 13 and 14 preferably are arranged horizontally. They may be connected to, and driven by, an appropriate motor 27 and gear arrangement (schematically shown in FIG. 1), which provide the power needed for turning the rollers. The space between the rollers forms a downwardly converging nip 28. The lower end of the nip provides a narrow gap 29 and the upper portion of the nip provides a wide entry opening 30. Scrap metal pieces 31 are dropped into the upper wide entry opening of the nip for passage through the converging nip 28 and narrow gap 29 for flattening the metal pieces.

To feed the scrap metal pieces into the nip, a conventional in-take conveyor 32, which is schematically shown in FIG. 1, may be used. The pieces are conveyed to a chute 35 so that they gravity slide down the chute into the nip. Arrows 36 schematically show the movement of the pieces 31 into and through the nip. The chute 35 may be provided with side guide rails 37 which keep the scrap pieces on the chute as they move downwardly into the nip.

Figure 2:
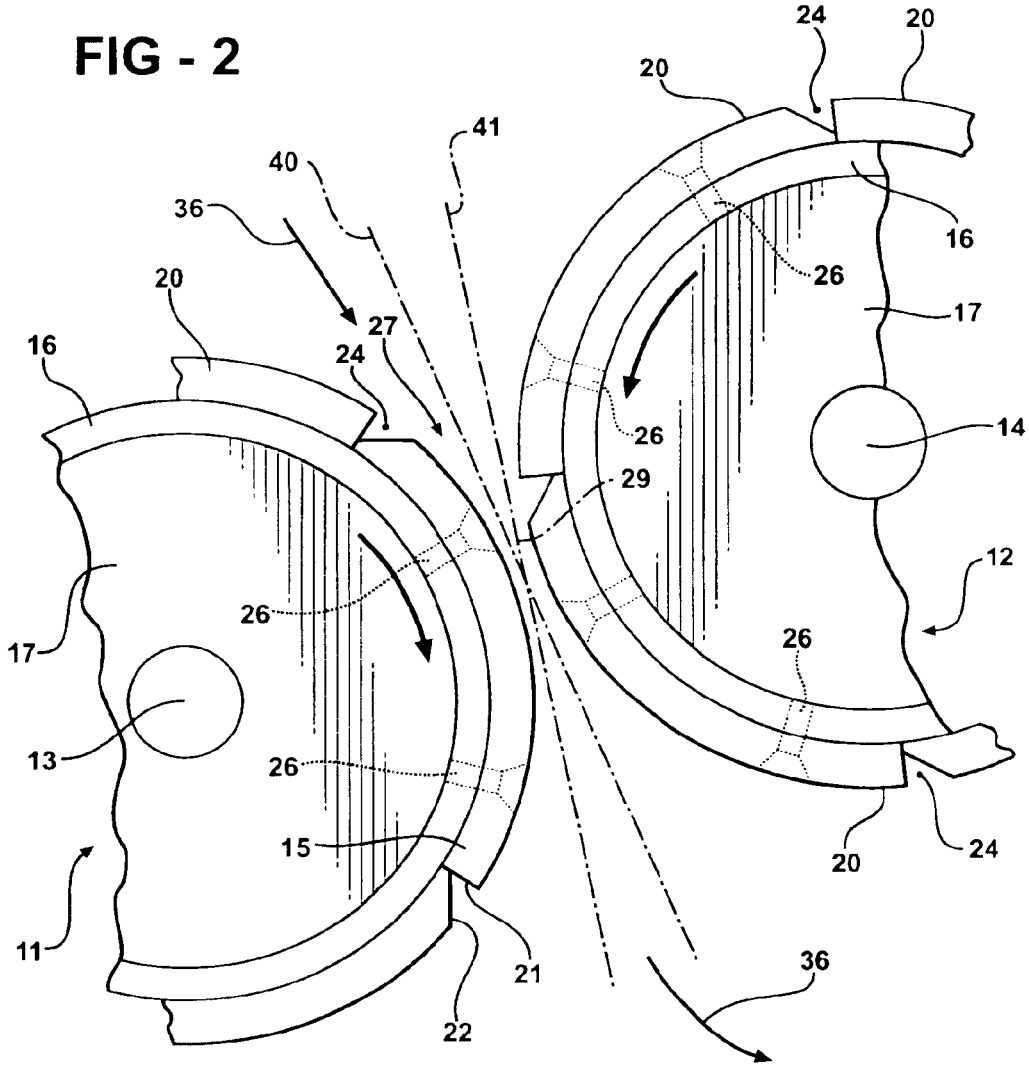
FIG. 2 is an enlarged, schematic, fragmentary view of the portions of the rollers forming the converging nip through which scrap metal is passed for flattening.

As schematically shown in FIG. 2, the nip is bisected by hypothetical plane 40 which is angled relative to a vertical plane 41. Similarly, the chute 35 is angled relative to the vertical. The arrangement provides an acute angle for the downward movement of the pieces relative to the vertical. As the roller 11 is lower than roller 13, the pieces sliding down the chute first land upon the surface of the lower roller 11. Therefore, the pieces are conveyed by that roller's rotating surface into the nip. The pieces are then assisted in moving through the nip by the engagement of the blunt, shoulders 25 of the grooves 24.

Although pieces of scrap would normally be conveyed, one by one, through the intake conveyor 32 and the chute 35, there is a tendency for the pieces to become entangled and to form clumps. If these clumps travel downwardly through the converging nip, they can jam the rollers or block the nip by hanging up above the narrow gap. That would stop the flattening action of the moving rollers. The stoppage of movement by the pieces is encouraged by the fact that in a typical sheet metal stamping process, which produces these scrap pieces, an oily or slippery substance may be applied to the surfaces of the sheet metal before the shaping or cutting of the metal occurs. That slippery surface coating material tends to accumulate on the exterior surfaces of the rollers so that the rollers are relatively slippery. Similarly, the pieces tend to be slippery. Thus, the reduced friction between the pieces and roller surfaces could cause the pieces to slide about above the narrow gap. The grooves overcome the tendency of the pieces to remain above the gap by engaging and pulling or pushing the pieces downwardly.

This invention may be further developed within the scope of the following claims. Having fully described an operative, preferred embodiment of this invention, I now claim:

What is claimed is:

1. A roller system for flattening irregularly shaped and bent pieces of scrap sheet metal comprising:

a pair of cylindrical, closely arranged, parallel rollers having longitudinally directed, parallel axes of rotation, said rollers forming a converging nip between them, with the nip having a wide entry opening for receiving pieces of scrap sheet metal placed in the nip and a narrow gap exit opening between the rollers for squeezing and flattening the pieces;

said rollers each being formed of curved metal sheets assembled into a cylindrical shape to provide cylindrical exterior surfaces;

a series of curved, hard steel, liner plates conforming to the curvatures of, and overlying the cylindrical surfaces of each of said rollers and being rigidly secured to said rollers;

the plates having longitudinally directed opposite ends and the plates, on each roller, being arranged in end-to-end relationship to form on each plate a leading edge and a trailing edge corresponding to the directions of rotations of the respective rollers;

said leading edges being approximately radially oriented relative to the center of curvatures of the curved surfaces of the rollers and being substantially of the same thickness as their respective plates;

said trailing edges being chamfered so as to form together with their adjacent leading edges approximately triangular in cross-section grooves extending longitudinally along the exterior surface of the plates of the respective rollers;

whereby pieces of scrap sheet metal placed into the wide entry opening of the nip tend to be moved towards the narrow gap by the leading edges of the respective grooves.

2. A roller system for flattening irregularly shaped pieces of scrap metal as defined in claim 1, and said roller axes being substantially horizontal so that said converging nip receives scrap pieces moving downwardly into the entry opening of the nip and exiting between the rollers through the narrow gap.

3. A roller system as defined in claim 2, and said liner plates overlapping and covering the exterior surfaces of the rollers and being formed of a substantially harder, less bendable metal material than the metal sheets which form the cylindrical rollers.

4. A roller system as defined in claim 3, and each of said rollers being of a diameter of at least roughly six feet and being spaced apart sufficiently to compress and substantially flatten irregularly shaped sheet metal pieces moved through the narrow gap of the nip, with the flattened scrap pieces dropping downwardly from the nip for collection.

5. A roller system as defined in claim 4, and the axis of one of the rollers being elevated relative to the axis of the other roller so that a plane bisecting the converging nip is angled relative to the vertical.

6. A roller system as defined in claim 5, and including a chute for transporting said pieces of scrap sheet metal into the nip, said chute having a surface upon which the pieces may slide into the nip, with the chute surface being arranged at an acute angle to the vertical for sloping downwardly at an angle relative to a vertical plane which includes the horizontal axis of the roller having the elevated axis.

7. A roller system as defined in claim 2, and said liner plates being releasibly secured to their respective rollers whereby said plates may be removed and replaced when the plates become worn or damaged.

8. A roller system as defined in claim 2, and at axes of at least one of the rollers being supported upon moveable support members which are moveable towards and away from the opposite roller for adjusting the width of the gap between the rollers.

* * * * *